US005327865A

United States Patent [19]

Riehemann

[11] Patent Number: 5,327,865

[45] Date of Patent: Jul. 12, 1994

[54] CONTROL SYSTEM FOR AN INTERNAL COMBUSTION ENGINE IN A MOTOR VEHICLE

[75] Inventor: Thomas Riehemann, Buehlertal, Fed. Rep. of Germany

[73] Assignee: Robert Bosch GmbH, Stuttgart, Fed. Rep. of Germany

[21] Appl. No.: 573,200

[22] PCT Filed: Dec. 15, 1988

[86] PCT No.: PCT/EP88/01162

§ 371 Date: Aug. 15, 1990

§ 102(e) Date: Aug. 15, 1990

[87] PCT Pub. No.: WO90/07054

PCT Pub. Date: Jun. 28, 1990

[51] Int. Cl.[5] ..... F02D 41/22; F02D 11/10

[52] U.S. Cl. ..... 123/397; 123/399

[58] Field of Search ..... 123/396, 397, 399, 333, 123/335, 361

[56] References Cited

U.S. PATENT DOCUMENTS

| | | | |
|---|---|---|---|
| 4,305,359 | 12/1981 | Mann et al. | 123/333 |
| 4,393,833 | 7/1983 | Mann et al. | 123/397 |
| 4,488,527 | 12/1984 | Pfalzgraf et al. | 123/399 |
| 4,519,360 | 5/1985 | Murakami | 123/399 |
| 4,603,675 | 8/1986 | Junginger et al. | 123/399 |
| 4,612,615 | 9/1986 | Murakami | 123/399 |
| 4,920,939 | 5/1990 | Gale | 123/399 |

*Primary Examiner*—Andrew M. Dolinar
*Attorney, Agent, or Firm*—Walter Ottesen

[57] ABSTRACT

A control system is provided for an internal combustion engine in a motor vehicle in which a potentiometer (11) responsive to the position of an accelerator pedal (12) provides a desired position signal to a comparator (15) controlling actuating signals to a servo motor (17) actuating a butterfly valve (18) and a second potentiometer (20) responsive to the position of the butterfly valve (18) provides a feedback signal to the comparator (15). The control system includes a safety device (24) controlling the fuel supply and/or ignition system, a third potentiometer (25) responsive to the position of the accelerator pedal (12), a fourth potentiometer (29) responsive to the position of the butterfly valve (18), and two threshold value switches (TS1,TS2) responsive respectively to the signals from the third and fourth potentiometers (25, 29) and providing output signals when such signals are respectively at or above a first predetermined voltage ($V_1$), and below a second predetermined voltage ($V_2$). The safety device (24) becomes operative in the absence of output signals from both the threshold value switches (TS1, TS2).

10 Claims, 1 Drawing Sheet

CONTROL SYSTEM FOR AN INTERNAL COMBUSTION ENGINE IN A MOTOR VEHICLE

FIELD OF THE INVENTION

The invention relates to a control system for an internal combustion engine in a motor vehicle. The control system actuates a regulating member such as a throttle butterfly valve in the intake manifold system of the engine.

BACKGROUND OF THE INVENTION

The present invention is more particularly concerned with a sensor system for providing a signal characterising the position of a vehicle driver operated command member and/or of a control member in a control system for an internal combustion engine.

In the control of an internal combustion engine in a motor vehicle, it is necessary to actuate a regulating member in the form of a butterfly valve in the intake manifold system of the engine in response to driver actuation of the accelerator pedal. Originally a mechanical linkage was used for this purpose and later a Bowden cable was preferred. Recently, advances in electronic control systems have led to the provision of a servo system for the regulating member and the first sensor responsive to the position of the accelerator pedal is in the form of a potentiometer and provides a control signal indicative of a desired position. A second sensor responsive to the actual position of the regulating member is also in the form of a potentiometer and provides a feedback signal indicative of the actual position of the regulating member. These signals are passed to a comparator which controls actuating signals to a servo motor which actuates the regulating member.

The absence of a direct mechanical connection between the accelerator pedal and the regulating member has led to the need of some form of safety device for preventing "runaway", that is, excessive engine speed such as could be caused by substantial disconformity between the actual position of the regulating member and the desired position as determined by the accelerator pedal; thus, disconformity could arise if the regulating member were in a wide open position when the accelerator pedal were in an engine idling position. For this purpose, switch contacts have been provided on the accelerator pedal and on the regulating member for controlling an engine speed reduction device. The switch contacts associated with the accelerator pedal are normally open and are closed after the pedal has been actuated a predetermined extent, while the switch contacts associated with the regulating member are normally closed and are opened when the regulating member has been moved a predetermined extent from its engine idling position. Both the switch contacts are connected in parallel to control the engine speed reduction device which is not normally operated and which when released effectively stops the engine, for example, by discontinuing the fuel supply or the ignition system. One system operating in this manner is disclosed in U.S. Pat. No. 4,305,359.

During normal engine running, the engine speed reduction device is operated. When the accelerator pedal is released and the regulating member is in the engine idling position, the circuit to the device is through the switch contacts associated with the regulating member, whereas when the accelerator pedal is depressed more than a predetermined extent, the switch contacts associated with the accelerator pedal close and provide a circuit for the device. As the regulating member is moved away from its engine idling position, at a predetermined point in its travel, the switch contacts associated with the regulating member are opened so that the circuit to the device is only through the switch contacts associated with the accelerator pedal. Ideally, one of the switch contacts would close as the other opens, but there is no guarantee that the regulating member will move in synchronism with the accelerator pedal and allowance has to be made for some time delay. Additionally, setting of the switch contacts to be actuated at precisely corresponding positions of the regulating member and accelerator pedal presents great difficulties and so, as a compromise, an overlap of closure of the switch contacts has to be arranged. A further disadvantage is that in the event of failure of the potentiometer associated with the accelerator pedal only a very restricted form of control based on the switch contacts associated therewith is possible and this control is virtually only two stage.

SUMMARY OF THE INVENTION

The control system of the invention overcomes the above disadvantages. The control system of the invention is for an internal combustion engine in a motor vehicle and actuates a regulating member such as a throttle butterfly valve in the intake manifold system of the engine in response to driver actuation of a command member such as an accelerator pedal. A first sensor in the command member is responsive to the position of the command member and is in the form of a potentiometer and provides a command signal indicative of a desired position. A sensor responsive to the actual position of the regulating member and in the form of a potentiometer provides a feedback signal indicative of its actual position. A comparator responsive to both of these signals controls actuating signals to an electromagnetic servomotor controlling the regulating member. A safety device is responsive to substantial disconformity between the desired position indicated by the command member and the actual position of the regulating member and establishes a substantial reduction in engine speed under predetermined conditions. The safety device includes: a third potentiometer responsive to the position of the command member; a first threshold value switch (TS1) providing an output signal when the signal from the third potentiometer is at or above a predetermined voltage ($V_1$); switch means responsive to the position of the regulating member and providing an output signal when the regulating member is within a predetermined range of positions from and including its engine idling position; and, and engine speed reduction device responsive to the threshold value switch output signal in parallel with the switch means output signal.

By replacing the switch contacts associated with the accelerator pedal by a potentiometer and a threshold switch, it is possible to control and adjust the position of the accelerator pedal at which a switching operation takes place; and when it is desired to change that position, the change can be effected electrically rather than mechanically by selecting the voltage at which the threshold switch operates. This makes it unnecessary to adjust switch contacts mechanically in relation to the accelerator pedal.

The switch means mentioned above includes a fourth potentiometer responsive to the position of the regulating member and a second threshold value switch (TS2) providing an output signal when the signal from the fourth potentiometer is below a predetermined voltage ($V_2$). With this feature of the invention, the advantages achieved in connection with the accelerator pedal can also be obtained in respect to the regulating member thereby making it possible for the voltages, at which the respective threshold switch is operated and thereby the corresponding positions of the accelerator pedal and regulating member, to be adjusted, maintained, or changed as desired.

According to two other features of the invention, the first and third potentiometers have a common track traversed by their sliders and the second and fourth potentiometers have a common track traversed by their sliders. These features greatly facilitate the sliders of the potentiometers to move in synchronism with each other, and thus the voltage signal provided by the slider of the third or fourth potentiometer, respectively, will correspond with a fair degree of accuracy with the voltage signals drawn from the sliders of the first and second potentiometers as a command signal and a feedback signal.

According to still other features of the invention, the third potentiometer can be used to provide the command signal to the comparator in the event of failure of the first potentiometer. Also, the fourth potentiometer can be used to provide the feedback signal to the comparator in the event of failure of the second potentiometer. These features provide for useful emergency operation in the event of failure of the first and/or second potentiometer since the signals drawn from the sliders of the third and fourth potentiometer, respectively, substantially correspond with those signals that would have been drawn from the sliders of the first and second potentiometers and can be used respectively for the same purposes. Thereby a continuously variable emergency control can be provided in the event of breakdown of the first and/or second potentiometer.

BRIEF DESCRIPTION OF THE DRAWINGS

The invention will now be described with reference to the drawings in which.

DESCRIPTION OF THE PREFERRED EMBODIMENTS OF THE INVENTION

Figure 1:
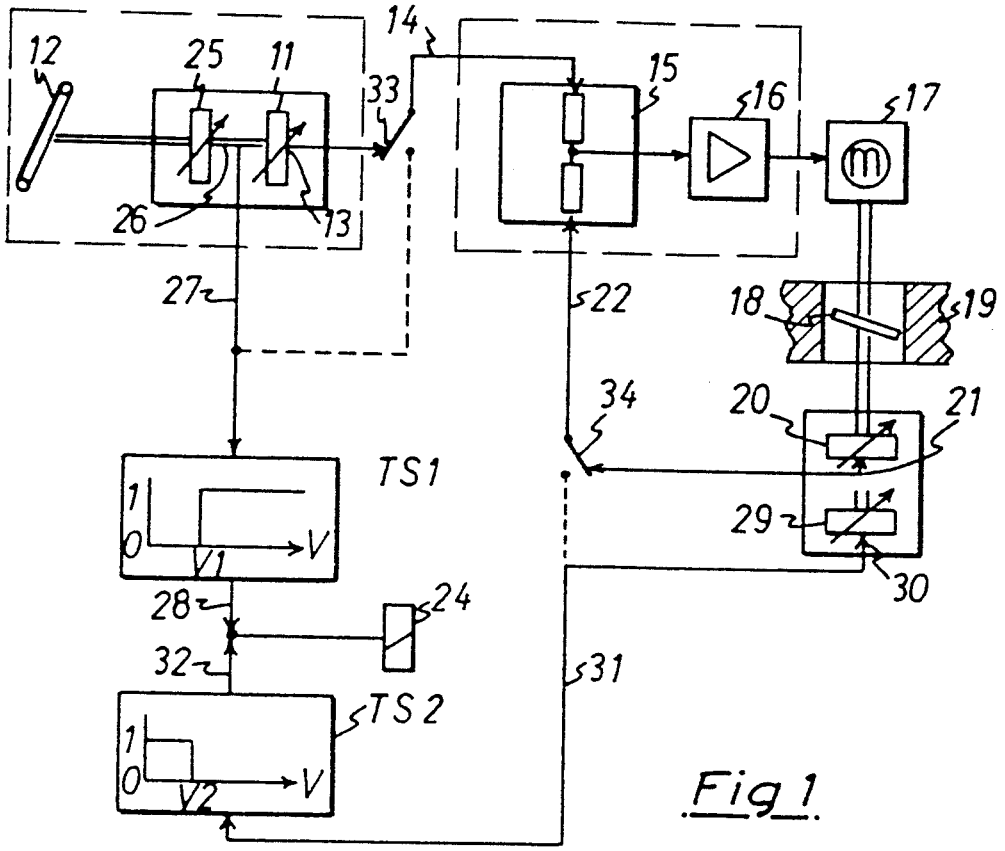
FIG. 1 is a schematic illustration of part of a control system for an internal combustion engine in a motor vehicle in accordance with one embodiment of the invention.

Referring initially to FIG. 1, a first potentiometer 11 is associated with an accelerator pedal 12 such that its slider 13 is moved along its track in synchronism with movement of the accelerator pedal 12. A signal drawn from the slider 13 is passed over line 14 to one input of a comparator 15 which, through a power amplifier 16, provides actuating signals to a servo motor 17 for actuation of a butterfly valve 18 in the intake manifold system 19 of an internal combustion engine (not shown). A second potentiometer 20 is associated with the butterfly valve 18 and its slider 21 is moved over its track in synchronism with movement of the butterfly valve 18. A signal drawn from the slider 21 is passed over line 22 to the comparator 15 as a positional feedback signal. In operation, depression of the accelerator pedal 12 by the driver indicates a desired position of the butterfly valve 18 and the servo motor 17 is actuated until the positional feedback signal provided by the potentiometer 20 balances the signal provided by the first potentiometer 11.

Figure 2A:
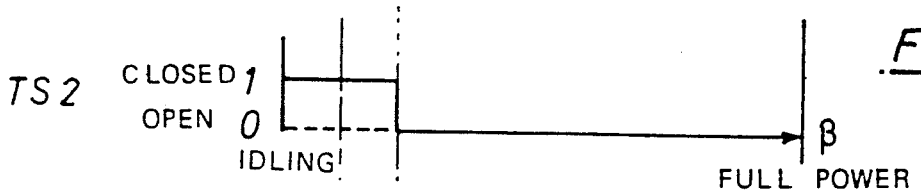
FIGS. 2*a*, 2*b* and 2*c* are graphical illustrations of the states of the threshold switches of FIG. 1 and the ratio of potentiometer slider voltage to potentiometer supply voltage against position of accelerator pedal or regulating member.
Figure 2B:
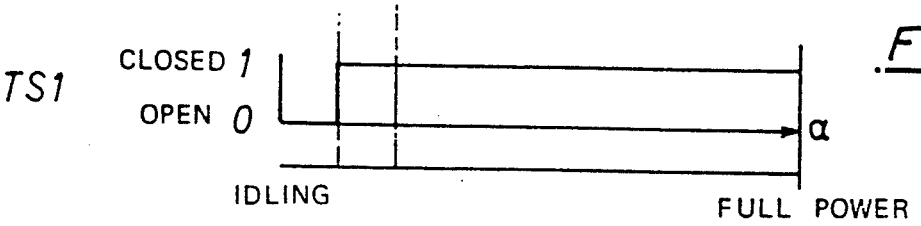
Figure 2C:
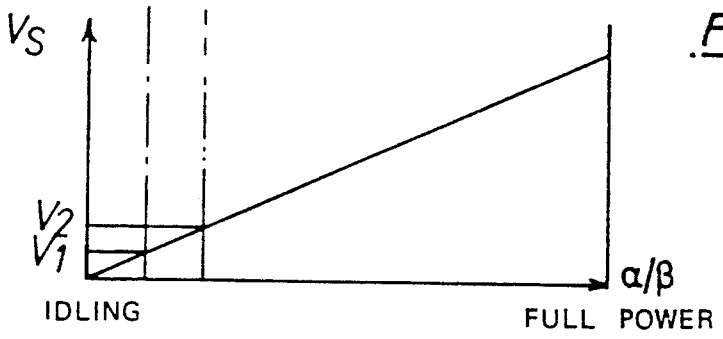

In the absence of a direct mechanical connection between the accelerator pedal and the butterfly valve 18, it is necessary to make some provision to avoid the establishment of "runaway" conditions such as might arise, for example, if the butterfly valve 18 were in a fully open position while the accelerator pedal 12 was released and in an engine idling condition. For this purpose, an engine speed reduction device is provided and is indicated generally at 24 and operates in a "fail safe" manner in that for normal operation it is energised. When de-energised or not operated, it effects a reduction in the engine speed either by cutting off the supply of fuel to the engine or by interrupting the ignition system or in any other suitable manner. Associated with the device 24 is a third potentiometer 25 associated with the accelerator pedal 12 and having a slider 26 which is moved over its track in synchronism with the slider 13 of the first potentiometer 11. A signal from the slider 26 is passed over line 27 to a first threshold switch TS1 which provides an output signal on line 28 when the incoming voltage signal on line 27 is equal to or exceeds a predetermined voltage V1. This is illustrated graphically in FIG. 2*a* and FIG. 2*c*. The horizontal scale represents the position of the accelerator pedal 12 or the butterfly valve 18 with the released or engine idling position at the left and the fully depressed or fully opened position at the right. In FIG. 2*c* the vertical axis represents the voltage signal VS at a potentiometer slider, while in FIG. 2*b* the vertical axis represents the condition of the first threshold switch 1, 0 corresponding to the switch open position and 1 to the switch closed position. It will be seen that as the accelerator pedal 12 is depressed, the slider voltage VS increases and that when it reaches the value V1, the threshold value switch TS1 changes state to produce an output signal which is present during the remainder of the travel of the accelerator pedal to its fully depressed condition. A fourth potentiometer 29 is associated with the regulating member 18 and its slider 30 is moved along its track in synchronism with the slider 21 of the second potentiometer 20. A signal from the slider 30 is passed on line 31 to a second threshold value switch TS2 which provides an output signal on line 32 until the input signal on line 31 is equal to or greater than a predetermined value V2 whereupon the threshold value switch changes state and no longer provides an output signal. This is illustrated graphically in FIGS. 2*a* and 2*c*. The output signals on lines 28 and 32 are fed to the engine speed reduction device 24. So long as either of the threshold value switches provides an output signal, the device 24 will remain operated, but whenever there is a discrepancy between the actual position of the butterfly valve 18 and the desired position as identified by the accelerator pedal 12 such that neither of the threshold value switches provides an output signal. The device 24 will then be released to discontinue the supply of fuel to the engine and/or to interrupt the ignition system. The engine speed is reduced and the danger of "runaway" is avoided.

The two potentiometers 11 and 25, and likewise the two potentiometers 20 and 29, can be combined in that the two sliders 13 and 26, and likewise 21 and 30, can travel over a common track thereby enabling the two sliders in each case to be moved substantially in synchronism with one another. Moreover, by virtue of the fact that the sliders 13 and 26 in normal operation produce substantially equivalent signals, it is possible in an emergency, for example with breakdown of the potentiometer 11, to utilize the signal from the slider 26 of the potentiometer 25 as the command signal to the comparator 15 and an emergency change-over switch 33 may be provided for this purpose. In a similar manner, an emergency change-over switch 34 may be associated with the potentiometers 20 and 29.

I claim:

1. A control system for an internal combustion engine in a motor vehicle for actuating a regulating member in the intake manifold system of the engine in response to driver actuation of a command member, the regulating member being driven by an electromagnetic servomotor and the control system comprising;

first sensor means for responding to the position of the command member to provide a command signal indicative of a desired position;

second sensor means for responding to the actual position of the regulating member to provide a feedback signal indicative of an actual position of said regulating member;

a comparator for responding to both of said signals for controlling an actuating signal for driving the electromagnetic servomotor;

safety means for responding to a substantial disconformity between said desired position of said command member and said actual position of the regulating member to cause a substantial reduction in engine speed under predetermined conditions; and, said safety means including; third sensor means for responding to the position of the command member to produce a signal; a threshold value switch for providing an output signal when said signal of said third sensor means is equal to or greater than a predetermined voltage ($V_1$); switch means for responding to the position of the regulating member to provide an output signal when the regulating member is within a predetermined range of positions from and including its engine idling position; and, speed reduction means for reducing the speed of the engine when both said output signal of said threshold value switch and said output signal of said switch means are not present.

2. The control system of claim 1, said regulating member being a throttle butterfly valve; said first sensor means being a first potentiometer; said second sensor means being a second potentiometer; said third sensor means being a third potentiometer; and, said switch means including; a fourth potentiometer responsive to the position of the regulating member and a second threshold value switch providing an output signal when the signal from said fourth potentiometer is below a predetermined voltage ($V_2$).

3. The control system of claim 2, wherein the predetermined voltage ($V_1$), at which the first threshold value switch (TS1) responds, corresponds to a desired position of the regulating member further from its engine idling position than the corresponding actual position of the regulating member.

4. The control system of claim 2, wherein the predetermined voltages ($V_1$, $V_2$), at which the first and second threshold value switches (TS1, TS2) change over, correspond to the same desired position as determined by the command member and the actual position of the regulating member.

5. The control system of claim 2, wherein said first and third potentiometers have a common track traversed by their sliders.

6. The control system of claim 2, wherein said second and fourth potentiometers have a common track traversed by their sliders.

7. The control system of claim 2, wherein said third potentiometer can be used to provide the command signal to said comparator in the event of failure of said first potentiometer.

8. The control system of claim 2, wherein said fourth potentiometer provides said feedback signal to said comparator in the event of failure of said second potentiometer.

9. The control system of claim 1, wherein said engine speed reduction means governs the supply of fuel to the engine.

10. The control system of claim 1, wherein said engine speed reduction means controls the ignition system of the engine.

* * * * *